United States Patent [19]

Dahlstrom et al.

[11] 4,319,936

[45] Mar. 16, 1982

[54] PROCESS FOR PRODUCTION OF ORIENTED SILICON STEEL

[75] Inventors: Norris A. Dahlstrom, Hamilton; Martin F. Littmann, Middletown, both of Ohio

[73] Assignee: Armco Inc., Middletown, Ohio

[21] Appl. No.: 214,441

[22] Filed: Dec. 8, 1980

[51] Int. Cl.[3] ..... H01F 1/04

[52] U.S. Cl. ..... 148/111; 148/31.5

[58] Field of Search ..... 148/110, 111, 112, 113, 148/31.5; 427/127

[56] References Cited

U.S. PATENT DOCUMENTS

| | | | |
|---|---|---|---|
| 3,636,579 | 1/1972 | Sakakura et al. | 148/111 |
| 3,764,406 | 10/1973 | Littmann | 148/111 |
| 3,770,517 | 11/1973 | Gray et al. | 148/111 |
| 3,855,019 | 12/1974 | Salsgiver et al. | 148/111 |
| 3,855,020 | 12/1974 | Salsgiver et al. | 148/111 |
| 3,855,021 | 12/1974 | Salsgiver et al. | 148/111 |
| 3,933,024 | 1/1976 | Matsumoto et al. | 148/111 |
| 3,959,033 | 5/1976 | Barisoni et al. | 148/111 |
| 4,014,717 | 3/1977 | Barisoni et al. | 148/112 |
| 4,123,298 | 10/1978 | Kohler et al. | 148/112 |

*Primary Examiner*—L. Dewayne Rutledge
*Assistant Examiner*—John P. Sheehan
*Attorney, Agent, or Firm*—Frost & Jacobs

[57] ABSTRACT

A process for the production of cube-on-edge oriented silicon steel of high permeability which comprises varying the temperature of the initial anneal and the quench starting temperature of the hot rolled steel in accordance with the aluminum and nitrogen contents of the steel. The initial anneal temperature ranges from about 1040° to 1175° C. and the quench starting temperature from about 700° to 1090° C. Improved permeability and core loss values are obtained over relatively broad aluminum and nitrogen ranges, viz., 0.024% to 0.040% total aluminum and 0.0050% to 0.0090% nitrogen, by ladle analysis.

4 Claims, 7 Drawing Figures

PROCESS FOR PRODUCTION OF ORIENTED SILICON STEEL

BRIEF SUMMARY OF THE INVENTION

This invention relates to a process for producing grain oriented silicon steel having cube-on-edge texture, and more particularly to heat treatment of hot rolled material so as to provide uniformly high permeability (measured at 800 ampere turns per meter) and low core loss (usually measured in watts per kilogram at 1.5 Tesla and higher).

Cube-on-edge oriented silicon steels (110) [001] have been used for a number of years in the manufacture of transformer cores and the like. The most common type of oriented silicon steel, which is generally referred to as regular grain oriented silicon steel, generally has a permeability at 796 A/m of less than 1850 and a core loss at 1.7 T and 60 Hz of greater than 0.700 W/lb when the strip thickness is about 0.295 mm. Such steels generally contain about 3.25% silicon, utilize manganese sulfide as a grain growth inhibitor, and are rolled to final thickness in two separate cold reduction steps. In recent years, workers in the art have developed new compositions and routings which have resulted in markedly improved magnetic characteristics. These products, which are commonly referred to as high permeability grain oriented steels generally have permeabilities greater than 1850 (at 796 A/m) and core losses less than 0.700 W/lb (at 1.7 T and 60 Hz) when the strip thickness is about 0.295 mm. These steels generally contain about 3.0% silicon, use two different grain growth inhibitors, e.g. manganese sulfide and aluminum nitride, and are rolled to final gauge with only one stage of cold reduction.

Manufacturers of transformers and the like must obtain the lowest possible energy loss in transformers because of the current adverse energy situation. One means of lowering the losses in a transformer is to use core materials which have high permeabilities and consequent low core losses.

In high permeability silicon steel both manganese sulfide and/or selenide and aluminum nitride are relied upon as grain growth inhibitors for the development of the desired orientation and magnetic properties. The desired form and distribution of manganese sulfide precipitates are obtained by controlling manganese and sulfur within the desired ranges during melting, by dissolving the precipitates during a slab reheating operation, and then by controlling the cooling rate during hot rolling. The desired form and distribution of aluminum nitride precipitates are also obtained by controlling aluminum and nitrogen within the desired ranges during the melting operation and dissolving the aluminum nitride compounds during slab reheating. Unlike manganese sulfide precipitation, however, which is essentially complete after hot rolling, only a small percentage of the aluminum nitride precipitates are formed during hot rolling. The remainder of the aluminum nitride precipitates form during the initial anneal and quenching operation of the hot rolled silicon steel band or sheet prior to cold rolling. Some change in the form of the manganese sulfide precipitates probably also takes place during the initial anneal. These steps are necessary for the production of a material which has superior permeability at high inductions. In commercial production it is very difficult to control the total aluminum and nitrogen contents within the narrow ranges required for precipitation of aluminum nitride throughout the steel in such a way as to result in optimum magnetic quality. If the aluminum and nitrogen levels are outside the prescribed narrow ranges, a high permeability product may still be obtained, but the core loss would not be low enough to be competitive in today's market.

Prior disclosures have described methods to obtain more uniform magnetic quality over the range of compositions encountered in producing high-permeability steel. These processes include cold rolling the strip at temperatures ranging from 100° to 350° C., as disclosed in U.S. Pat. No. 3,933,024, or subjecting the steel to a further anneal following decarburization at a temperature of from about 950° to about 1175° C. for a time ranging from about 15 seconds to about 5 minutes, as disclosed in U.S. Pat. No. 4,123,298. The practices taught in these and other patents are generally not practical for use in commercial production because of the excessively high processing costs. Thus, the development of the present invention, which controls aluminum nitride precipitation throughout the silicon steel prior to cold rolling by a simple and inexpensive process, is in response to a genuine need. The present invention constitutes a discovery that variation in heat treatment conditions to which hot rolled silicon steel is subjected can compensate for variations in the aluminum and nitrogen contents, thereby broadening the aluminum and nitrogen ranges without adversely affecting core loss and magnetic permeability values.

Prior to the present invention, the normal practice by the assignee of the present application has been to soak hot rolled silicon steel at about 1115° C. (2040° F.) for 90 seconds, air cool the steel to a temperature of about 870° C. (1600° F.), and water quench to below 400° C. This practice remained constant within a prescribed aluminum range of 0.028% to 0.036% by weight (total aluminum—ladle sample) and a prescribed nitrogen range of 0.0055% to 0.0080% by weight (ladle sample). No adjustment in annealing and cooling practice was made for variations in aluminum and nitrogen content of the melting heats.

U.S. Pat. No. 3,636,579 discloses a method for producing silicon steel having high magnetic induction which includes subjecting hot rolled silicon steel band or sheet to an initial anneal at 750° to 1200° C. for 30 seconds to 30 minutes, followed by quenching to precipitate nitrogen as aluminum nitride. The annealing temperature is varied in accordance with the silicon and carbon contents, and the quenching is conducted so as to reduce the sheet to a temperature below 400° C. in 2 to 200 seconds. Aluminum ranges from 0.01% to 0.065%, silicon from 0 to 4%, and carbon less than 0.085%.

U.S. Pat. No. 3,959,033 discloses an initial anneal of hot rolled silicon steel sheet at a temperature of 1050° to 1170° C., and preferably at 1120° to 1170° C., for 10 to 60 seconds, followed by slow cooling of the strip to 700° to 900° C. at a rate less than 10° C. per second. This is followed by a drastic quench at a rate of 15° to 150° C. per second. The purpose of this treatment is to develop a high hardness phase which is described as being necessary in order to develop a high permeability product. The annealing and quench conditions are not varied in any way relative to variations in the steel composition.

U.S. Pat. No. 4,014,717 discloses a method for producing high permeability material when the strand cast slabs are direct rolled. The initial anneal of hot rolled band comprises soaking at a temperature of 1050° to 1150° C. for 5 to 30 seconds, followed by cooling in air to a temperature range of 750° to 850° C. The steel is then quenched at a rate of 10° C. to 100° C. per second to a temperature below 400° C. The quench rate varies with the carbon and silicon contents.

U.S. Pat. No. 3,855,019 discloses an initial anneal at 760° to 927° C. for a time ranging from 15 seconds to 2 hours, followed by a cooling rate equipvalent to a still air cool. Carbon ranges from 0.02% to 0.07%, silicon from 2.6% to 3.5%, manganese from 0.05% to 0.27%, sulfur from 0.01% to 0.05%, aluminum from 0.015% to 0.04%, nitrogen 0.003% to 0.009%, and copper from 0.1% to 0.3%. Further, manganese and copper are restricted by what is defined as the manganese equivalent which equals $$\%Mn+(0.1 \text{ to } 0.25)\times\%Cu.$$

This patent also alleges that the addition of copper lowers the initial annealing temperature, improves rollability, simplifies melting, and relaxes annealing atmosphere rerequirements.

U.S. Pat. No. 3,855,020 discloses an anneal at 760° to 1177° C. for a time ranging from 15 seconds to 2 hours, followed by cooling from the anneal temperature to a temperature ranging from 399° to 927° C. at a rate no faster than a still air cool, followed by cooling to a temperature below 260° C. at a rate faster than a still air cool. This anneal precedes a final cold reduction of at least 80%. The composition ranges are the same as those used in U.S. Pat. No. 3,855,019.

U.S. Pat. No. 3,855,021 discloses an anneal from 760° to 927° C. for a time ranging from 15 seconds to 2 hours, followed by cooling at a rate equivalent to a still air cool. This anneal precedes a final cold reduction of at least 80%. The composition ranges are the same as those used in U.S. Pat. No. 3,855,019.

It is a principal object of the present invention to solve the problem of incomplete secondary grain growth and large and/or poorly oriented secondary grains by variation in the heat treatment to which the hot rolled silicon steel band is subjected prior to cold reduction to accommodate variations in aluminum and nitrogen contents.

It is a further object to broaden substantially the aluminum and nitrogen ranges within which high permeability material can be successfully produced commercially.

BRIEF DESCRIPTION OF THE DRAWING

Reference is made to the accompanying drawing wherein.

DETAILED DESCRIPTION

The above objects are achieved in accordance with the invention in a process for producing oriented silicon steel having improved core loss and magnetic permeability in the rolling direction, comprising the steps of hot rolling a steel containing up to 0.07% carbon, about 2.7% to 3.3% silicon, about 0.05% to about 0.15% manganese, about 0.02% to about 0.035% sulfur and/or selenium, about 0.024% to about 0.040% total aluminum, about 0.0050% to about 0.0090% nitrogen, and balance essentially iron, subjecting the hot rolled steel to an initial anneal, slowly cooling the steel, water quenching to a temperature below about 400° C., cold rolling to final thickness in at least one stage of cold reduction, decarburizing the steel, applying an annealing separator, and subjecting the steel to a final anneal in a reducing atmosphere at a temperature of at least about 1090° C., the improvement comprising varying the temperature of the initial anneal within the range of 1040° to 1175° C. and the temperature at which the water quenching is started in accordance with the aluminum and nitrogen contents of the steel, whereby to obtain substantially complete secondary grain growth and to avoid large and/or poorly oriented secondary grains. It should be noted that about 0.002% of the total aluminum present is insoluble because it has combined with oxygen to form aluminum oxide and is therefore unavailable to form aluminum nitride precipitates. The aluminum levels given herein are total aluminum contents, unless otherwise stated.

A number of dependent variables are involved in solution of the problem of obtaining optimum magnetic quality, the effects of which are not yet fully understood. However, it has been found that the highest degree of orientation is obtained if the initial anneal temperature is within the range of 1040° to 1175° C. with the quenching start selected to allow precipitation of an adequate amount of aluminum nitride in finely dispersed form uniformly throughout the steel. If the aluminum content is relatively high under these conditions, there is a danger of incomplete secondary growth. On the other hand, under these same conditions if the aluminum content is low there is danger of large grain size and/or poor orientation.

Figure 1:
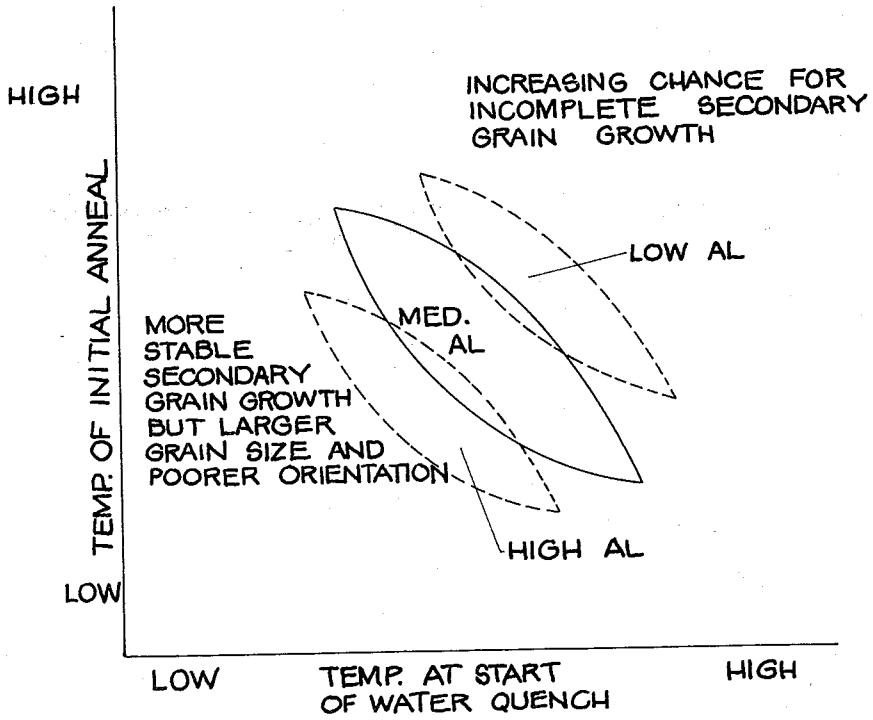
FIG. 1 is a graphic schematic illustration of the effects of initial annealing temperature and quench start temperature on magnetic quality for different aluminum levels.

Referring to FIG. 1 of the drawing, it is evident that for a given aluminum and nitrogen level, best magnetic quality is assured with the combination of a high initial anneal temperature with a low quench start temperature and vice versa. As illustrated qualitatively in FIG. 1 the broadest area within which optimum magnetic quality is obtained occurs approximately at the middle of each of the initial anneal temperature range and the quench start temperature range for a given aluminum level. It is significant that the amount of aluminum and/or nitrogen which is present in the steel shifts the optimum initial anneal temperature range and/or the quench start temperature range. Generally, for a constant nitrogen level, heats with lower amounts of aluminum require a higher initial anneal temperature and/or a higher quench start temperature than do heats with higher amounts of aluminum, for optimum magnetic quality.

The cooling rate during the water quench should be controlled so that the quench time from start until reaching a temperature below about 400° C. is less than about 200 seconds and preferably is from 10 to 50 seconds.

In the preferred practice of the process of the invention a silicon steel melt is prepared in conventional manner and may be cast into ingots or continuously cast. If continuous casting practice is followed, the processing disclosed in U.S. Pat. No. 3,764,406, issued Oct. 9, 1973, to the assignee of the present application, is preferred.

The ingots or slabs are reheated within the range of 1280° to 1430° C. prior to hot rolling, and hot rolling is preferably carried out by roughing, followed by finishing to a hot band thickness of about 1.8 to about 2.5 mm.

The hot rolled band is then subjected to an initial continuous anneal within the range of about 1040° to about 1175° C., this temperature being varied in accordance with the aluminum and nitrogen contents of the steel as hereinafter explained in detail, with a soaking time ranging from about 30 seconds to about 3 minutes, followed by air cooling until the steel reaches a temperature of about 700° to 1090° C. The steel is then quenched in water to a temperature below about 400° C.

The annealed band is then subjected to scale removal and cold rolled to final thickness in at least one stage. The temperature of the steel during the cold rolling operations generally is less than 150° C. When more than one stage of cold reduction is used, the above described anneal and quench should be followed by a cold reduction of at least 80%.

After cold rolling to final thickness (which may be greater than about 0.20 up to about 0.45 mm) the strip is decarburized to a carbon level preferably not greater than about 0.003%. A strip anneal in wet hydrogen at about 820° to about 850° C. may be used for decarburization.

The decarburized strip is then coated with an annealing separator and subjected to a final anneal at a temperature of at least about 1090° C. and preferably between about 1150° and 1220° C. for a period of time up to 36 hours in a dry hydrogen-containing atmosphere reducing to oxides of iron, thereby effecting secondary recrystallization. A portion of the final anneal may be conducted in a nitrogen or nitrogen-hydrogen atmosphere.

The above described processing is generally conventional except for the initial annealing, cooling and quenching conditions to which the hot rolled band is subjected.

When aluminum is in the upper portion of the range of 0.024% to 0.040% total aluminum (ladle analysis) and/or when nitrogen is in the lower portion of the range of 0.0050% to 0.0090% (ladle analysis) water quenching after the initial continuous anneal is started within the temperature range of 700° to less than 870° C. More specifically, referring to FIG. 2, when the aluminum and nitrogen contents are to the right of and below the straight lines defined by percent nitrogen=0.0090% and percent nitrogen=0.83×percent aluminum−0.022%, the initial annealing temperature ranges from about 1040° to less than about 1115° C., and the water quench is started at a temperature of about 700° to less than about 870° C.

When aluminum is in the lower portion of the range of 0.024% to 0.040% total aluminum and/or when nitrogen is in the upper portion of the range of 0.0050% to 0.0090% nitrogen, water quenching after the initial anneal is started within the temperature range of greater than 870° to 1090° C. More specifically, and again referring to FIG. 2, when the combined aluminum and nitrogen contents fall to the left of and above the straight lines defined by percent nitrogen=0.0060% and percent nitrogen=0.83×percent aluminum−0.0184%, the initial anneal temperature ranges from greater than about 1115° to about 1175° C., and the water quenching is started at a temperature of greater than about 870° to about 1090° C.

Figure 2B:
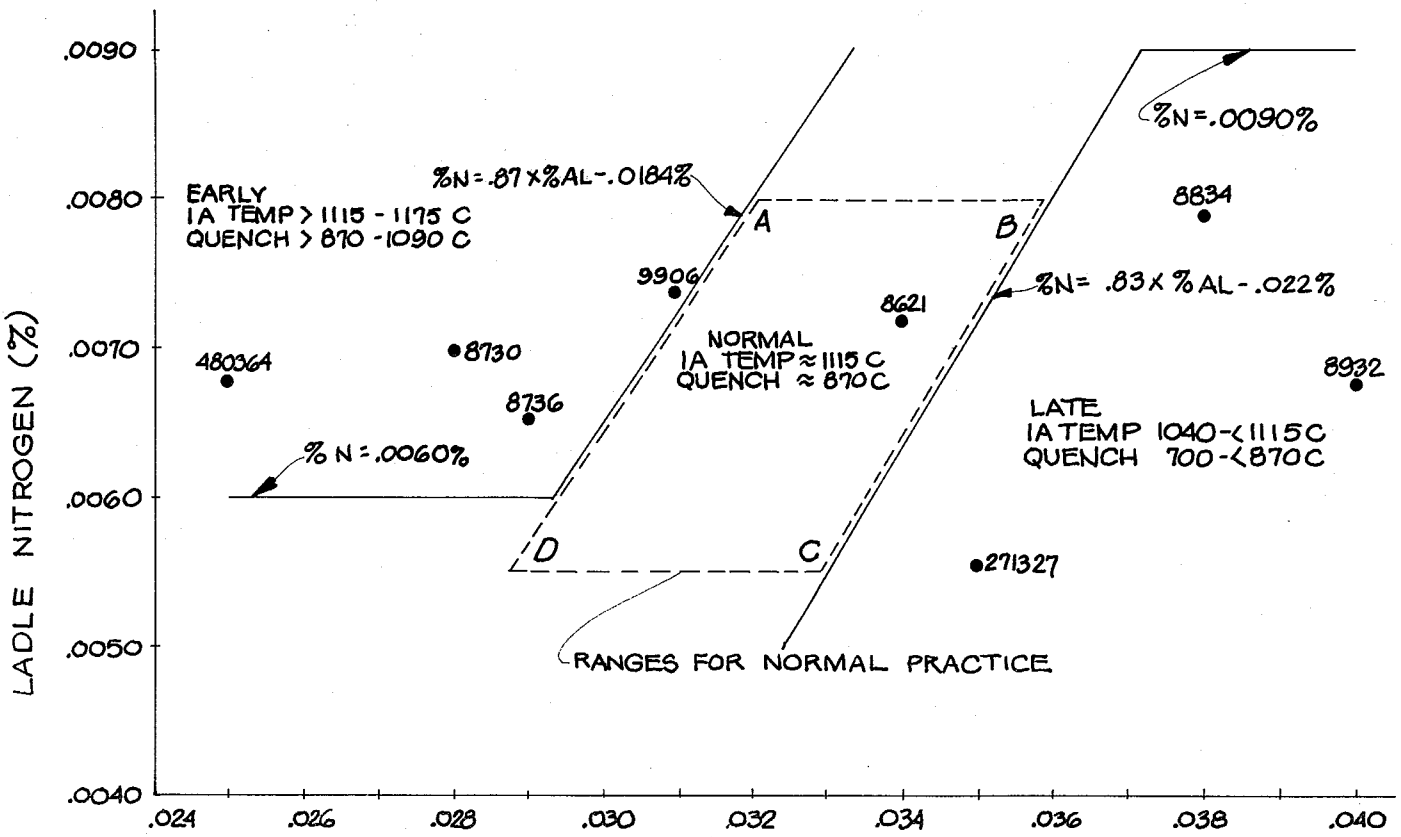
FIG. 2 is a graphic representation of variations in initial anneal and quench start temperatures in relation to variations in aluminum and nitrogen contents.

As will be apparent from FIG. 2, the area ABCD defines the only aluminum and nitrogen ranges within which the above described normal practice can be relied upon to obtain good magnetic quality without variation of the initial anneal conditions from the normal practice. As indicated hereinabove, the normal practice by the assignee of the present application has been to subject the hot rolled band to an initial continuous anneal at about 1115% for 90 seconds, air cool to about 870° C., and water quench to room temperature.

Samples from commercial heats have been subjected to laboratory processing under varying initial anneal and quench conditions. The aluminum and nitrogen contents of two such heats (460626AV and 360774AV), and the magnetic properties, after cold reduction and final annealing, of these heats are set forth in Table I together with the heat treatment conditions to which the various samples were subjected. The procedure was as follows:

Hot band samples 2.36 mm thick were annealed as indicated in Table I in a nitrogen atmosphere for a total time of 4.5 minutes. Samples were air cooled for the times specified in Table I and then were quenched in warm water. After cold rolling to 0.292 mm thickness, the samples were decarburized at about 830° C. in hydrogen having a dew point of about 60° C. The samples were then coated with magnesia and finally annealed at 1200° C. for 30 hours in dry hydrogen, using a heating rate of 40° C. per hour from about 590° to about 1200° C. in a 25% nitrogen—75% hydrogen atmosphere by volume. After shearing the Epstein samples were stress relief annealed before testing.

All the initial anneal treatments described above fall within the limits disclosed in the previously mentioned U.S. Pat. No. 3,636,579. These results show that magnetic quality, as measured by permeability at H=796 A/m, varies widely with initial anneal temperature and with the time the samples were air cooled prior to the water quench. Several of the treatments did not result in a high permeability product, and only a few resulted in products which would be considered competitive in today's market.

Tables II, III and IV demonstrate the benefit of adjusting the initial anneal and quench conditions in order to obtain optimum magnetic quality.

Tables II and III each contain data on one heat, and the location of these two heats with respect to aluminum and nitrogen contents, initial anneal temperatures and quench start temperatures is plotted in FIG. 2. The data in Tables II and III were conducted on hot band samples obtained from commercial heats with compositions of each heat being set forth in these tables. The samples were processed in the laboratory as follows: initial anneals were conducted at about 1050° C., 1100° C. and 1165° C. with a total furnace time for each of 5¼ minutes and time at temperature about 90 seconds. Water quenching was conducted either as early (1065° C.), normal (870° C.) or late (715° C.) on samples from the two heats in Tables II and III. Samples were then cold rolled to 11.2 mils, decarburized, coated with magnesia, box annealed for 20 hours at 1205° C. in dry hydrogen, and finally subjected to a stress relief anneal. Samples were then tested for core loss and permeability. The test results are set forth in Tables II and III and are also plotted in FIGS. 3, 4, 5 and 6.

Figure 3:
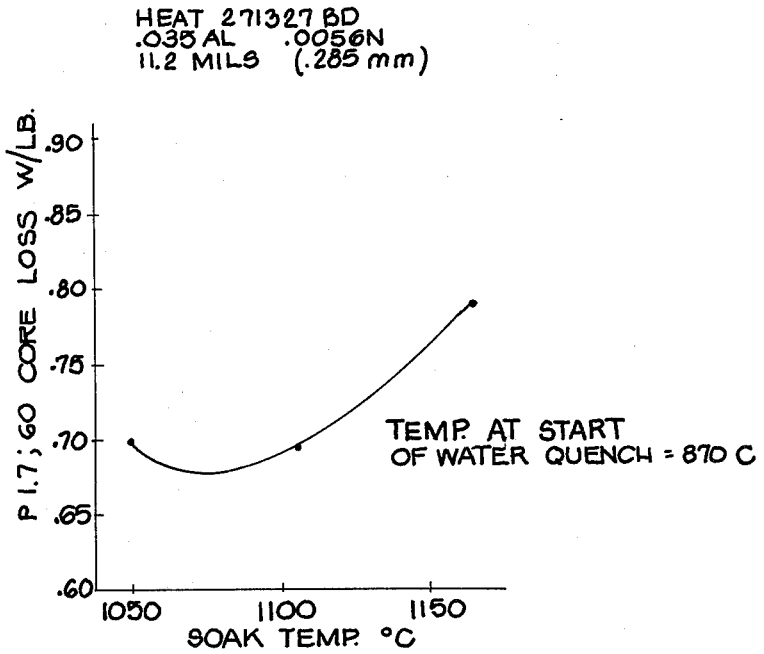
FIGS. 3 and 4 are graphic representations of the effect of initial anneal temperature on core loss.
Figure 5:
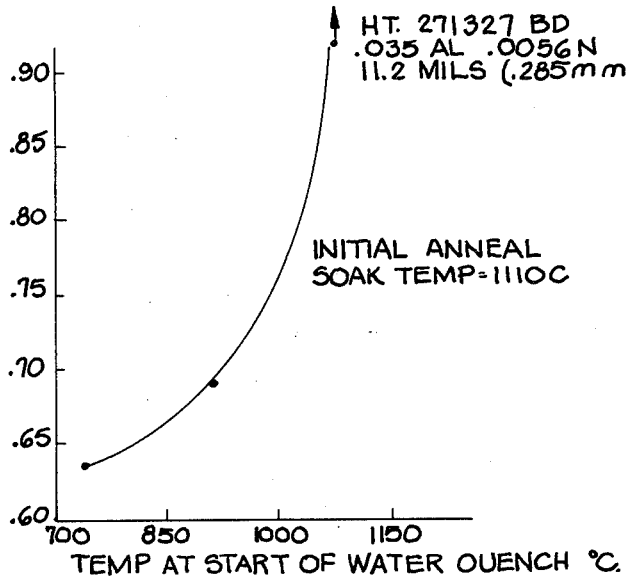
FIGS. 5 and 6 are graphic representations of the effect of quench start temperature on core loss.

Considering first heat 271327 in Table II and FIGS. 3 and 5, it will be noted that the core loss increased as the initial anneal temperature was increased from 1100° C. to 1165° C. The core loss also increased as the quench start temperature increased, as will be evident from FIG. 5.

Figure 4:
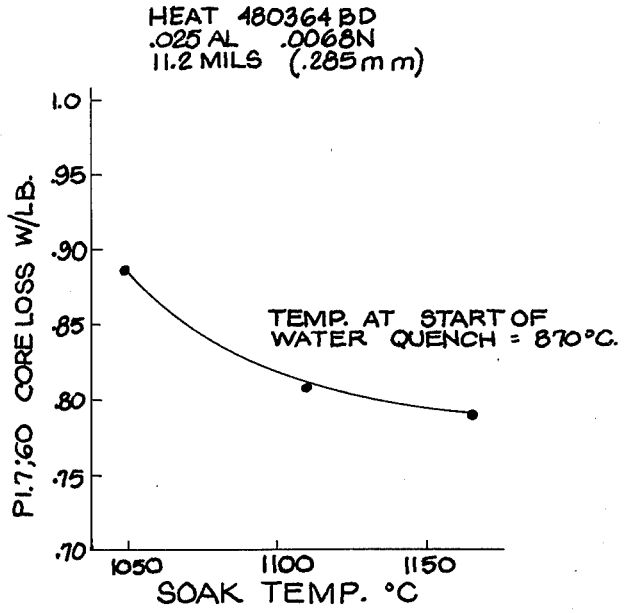
Figure 6:
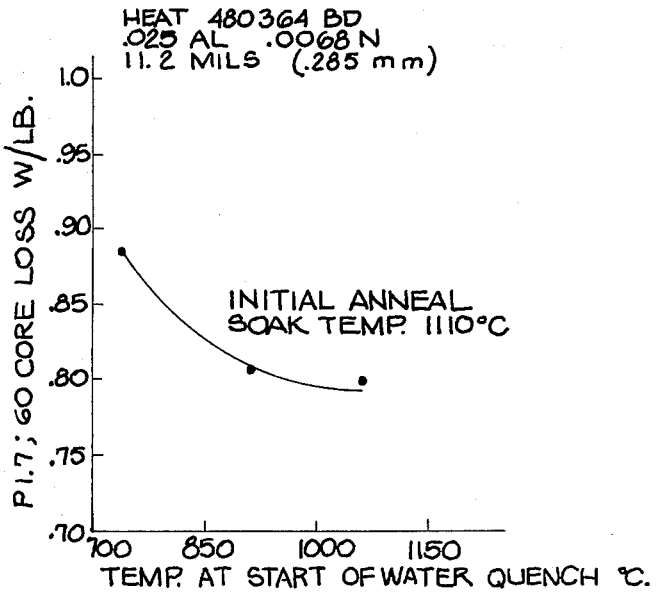

Considering next heat 480364 BD as shown in Table III and FIGS. 4 and 6, core loss decreased as the initial anneal temperature was increased for a quench start temperature of 870° C. Core loss also decreased as the temperature at the start of water quenching increased for initial anneals at 1050° C. and 1110° C. The overall magnetic quality of this heat is not good, but this is attributable to the low aluminum content which is outside the preferred range.

The results summarized in Tables II and III and in FIGS. 3–6 confirm the general principles set forth hereinabove, namely that high aluminum and/or low nitrogen produce better magnetic quality with a lower initial anneal temperature and/or a lower quench start temperature, and that low aluminum and/or high nitrogen exhibit better quality with a high initial anneal temperature and/or a high quench start temperature.

Additional tests were performed again using hot-band samples from commercial heats, and results are summarized in Table IV. The location of these heats with respect to aluminum and nitrogen contents are also plotted in FIG. 2.

Initial anneal soak temperatures and quench start temperatures are set forth in Table IV. All other processing variables were the same as those in Tables II and III.

Considering first heat 8621, the combined aluminum and nitrogen levels would indicate a normal initial anneal temperature and a normal quench start temperature when processed in accordance with the present invention. Table IV shows relatively uniform magnetic quality for quench start temperatures at several levels at a soak temperature of 1120° C., thus confirming the theory of the process of the invention.

Heats 8730 and 8736 had combined aluminum and nitrogen levels which would call for an initial anneal between about 1115° and 1175° C., and a quench start temperature ranging from 870° to 1090° C. in accordance with the present invention. The results for an initial anneal at 1120° C. in Table IV confirm this. In the case of heat 8730 magnetic quality for a soak temperature of 1105° C. and a quench start temperature of 845° C. was better than expected. Unexpected variations, such as this one, still occur. The teaching of this patent minimizes but does not eliminate these variations.

Heat 8834 should be processed at an initial anneal temperature of 1040° to 1115° C. and a quench start temperature between 700° and 870° C. in accordance with the present invention. The results for the soak temperature of 1120° C. show that best magnetic quality was obtained with a quench start temperature of 760° C. However, the lower initial anneal temperature of 1105° C. and the slightly higher quench start temperature of 845° C. produced still better magnetic quality.

Figure 7:
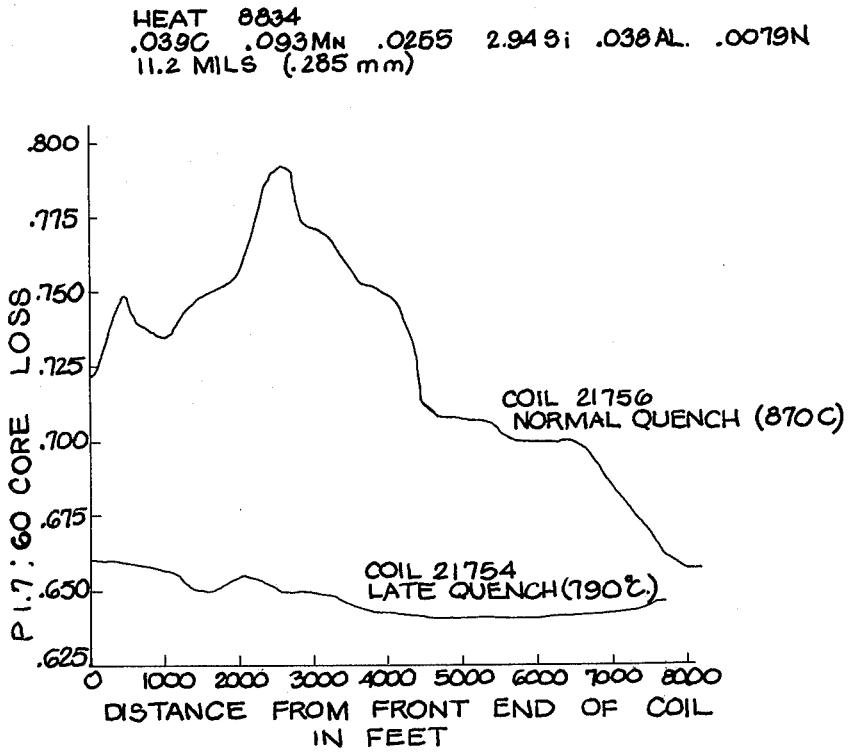
FIG. 7 is a graphic representation of core loss along the lengths of comparative coils.

Two coils from heat 8834 containing 0.038% total aluminum and 0.0079% nitrogen by ladle analysis were also subjected to complete plant processing. Both coils were given an initial anneal at 1115° C., with one coil (21756) being water quenched from the normal temperature of about 870° C. and the other coil (21754) being water quenched from 790° C. Core loss was measured along the length of both coils in the plant processing line following application of a secondary coating. The core loss values along the length of both coils are plotted in FIG. 7. It is evident from FIG. 7 that the core loss for coil 21754 which was water quenched from 790° C. was not only lower but also much more uniform than that for coil 21756, which was water quenched from 870° C.

A coil from another commercial heat 8932 was subjected to a plant trial. The ladle analysis for heat 8932 was 0.043% carbon, 0.094% manganese, 0.025% sulfur, 2.90% silicon, 0.040% aluminum and 0.0068% nitrogen, all percentages being by weight. The initial anneal soak was at 1095° C. The front portion of this coil was water quenched from 760° C., while the back portion was water quenched from 845° C. Core loss and permeability values for the front and back portions of this coil are set forth in Table V. It will be noted that the front portion, subjected to an initial anneal at 1095° C. and a quench start temperature of 760° C. with a final thickness of 0.267 mm, exhibited excellent magnetic properties. It has been previously impossible to obtain magnetic properties of this high quality with the normal initial anneal and quench conditions for this combination of aluminum and nitrogen levels.

Another commercial heat 9906 was also subjected to plant trials for comparison of the effect of an early quench and a normal quench. Heat 9906 had a ladle analysis of 0.043% carbon, 0.092% manganese, 0.027% sulfur, 2.89% silicon, 0.031% aluminum and 0.0073% nitrogen, by weight percent. Eleven coils were subjected to an initial anneal temperature of 1115° C., with seven coils being water quenched from 982° C. and the other four coils being quenched from 870° C. The core loss and permeability values for these coils are set forth in Table V, and it is again evident that the early quench from a start temperature of 982° C. resulted in superior magnetic properties for this combination of aluminum and nitrogen levels.

The above data thus empirically establish that the initial anneal temperature should range from about 1040° to less than about 1115° C. and water quench should be started at a temperature of about 700° to less than about 870° C. when the aluminum and nitrogen contents are to the right of and below the straight lines defined by percent nitrogen = 0.0090% and percent nitrogen = 0.83 × percent aluminum − 0.022% in FIG. 2.

Further, initial anneal temperature should range from greater than about 1115° to about 1175° C., and the quench start temperature should range from greater than about 870° to about 1090° C. when the combined aluminum and nitrogen contents are to the left of and above the straight lines defined by percent nitrogen = 0.0060% and percent nitrogen = 0.83 × percent aluminum − 0.0184% in FIG. 2.

By way of non-limiting example, with total aluminum equal to or greater than about 0.032% and nitrogen about 0.0050%, or with total aluminum equal to or greater than 0.037% and nitrogen about 0.009%, the initial anneal should be between about 1040° and less than 1115° C., and the water quench start should be between about 700° and less than about 870° C. At the opposite extreme, with total aluminum less than about 0.029% and nitrogen about 0.006%, or total aluminum less than about 0.033% and nitrogen about 0.009%, the initial anneal should be between greater than about 1115° and 1175° C., and the water quench start should be between greater than about 870° and 1090° C. Since the previously used normal practice has been an initial anneal at 1115° C. and a water quench start at 870° C., these two temperatures are excluded in the appended claims.

It is apparent that variation in the initial anneal and quench start conditions in accordance with the present invention expands the aluminum and nitrogen ranges which can be used without sacrifice in magnetic properties. Since control of the aluminum and nitrogen levels within a tight range has long been a problem in the manufacture of high permeability silicon steel the present invention permits maintenance of equivalent magnetic quality at a lower production cost. Moreover, since the variation in heat treatment conditions is based on ladle samples of aluminum and nitrogen, control is greatly simplified, and predictability of magnetic quality is facilitated at an early stage in the production process.

TABLE I

| Heat | Total N ppm | % Al Acid-soluble | Anneal Temp. & Air Cooling Time Before Quench: 1065° C. 0 sec. | 1065° C. 60 sec. | 1120° C. 10 sec. | 1175° C. 0 sec. | 1175° C. 60 sec. |
|---|---|---|---|---|---|---|---|
| 460626AV | 62 | 0.033 | | | | | |
| Permeab. | | | 1893 | 1903 | 1921 | 1595 | 1930 |
| 360774AV | 77 | 0.030 | | | | | |
| Permeab. | | | 1874 | 1837 | 1863 | 1536 | 1912 |

TABLE II

Heat 271327BD 0.041% C, 0.10% Mn, 0.027% S, 2.92% Si, 0.035% Al, 0.0056% N

| Initial Anneal Temp. °C. | Strip Thickness mm | Quench Start Temp. °C.: 1065° (Early) P1.7;60 | 1065° (Early) H = 10 | 870° (Normal) P1.7;60 | 870° (Normal) H = 10 | 715° (Late) P1.7;60 | 715° (Late) H = 10 |
|---|---|---|---|---|---|---|---|
| 1050° | 0.285 | — | — | 0.700* | 1864 | — | — |
| 1110° | 0.285 | 1.012* | 1702 | 0.689** | 1877 | 0.632* | 1928 |
| 1165° | 0.285 | — | — | 0.786* | 1814 | 0.636* | 1920 |

TABLE III

Heat 480364BD 0.04% C, 0.110% Mn, 0.029% S, 2.83% Si, 0.025% Al, 0.0068% N

| | | | | | | | |
|---|---|---|---|---|---|---|---|
| 1050° | 0.285 | — | — | 0.876* | 1826 | — | — |
| 1110° | 0.285 | 0.800* | 1848 | 0.812** | 1857 | 0.874* | 1822 |
| 1165° | 0.285 | — | — | 0.792* | 1854 | — | — |

*Average of 2 tests
**Average of 4 tests

TABLE IV

| Heat | Ladle Wt. % Al | Ladle Wt. % N | 0.285 mm Strip Thickness: 1120°* 980°** P1.7;60 | 1120°* 980°** H = 10 | 1120°* 870°** P1.7;60 | 1120°* 870°** H = 10 | 1120°* 760°** P1.7;60 | 1120°* 760°** H = 10 | 1105°* 845°** P1.7;60 | 1105°* 845°** H = 10 | 1140°* 900°** P1.7;60 | 1140°* 900°** H = 10 |
|---|---|---|---|---|---|---|---|---|---|---|---|---|
| 8621 | 0.034 | 0.0072 | 0.662 | 1913 | 0.669 | 1915 | 0.678 | 1910 | 0.685 | 1901 | 0.682 | 1896 |
| 8730 | 0.028 | 0.0070 | 0.641 | 1917 | 0.703 | 1895 | 0.728 | 1891 | 0.673 | 1898 | 0.664 | 1910 |
| 8736 | 0.029 | 0.0066 | 0.641 | 1914 | 0.653 | 1912 | 0.775 | 1869 | 0.697 | 1891 | 0.659 | 1918 |
| 8834 | 0.038 | 0.0079 | 0.828 | 1799 | 0.784 | 1817 | 0.764 | 1832 | 0.653 | 1893 | 0.899 | 1757 |

*Initial Anneal Temp. °C.
**Water Quench Start Temp. °C.

TABLE V

PLANT TRIAL

| Initial Anneal °C | Strip Thickness mm | Quench Start Temp. °C | Core Loss P1.7;60 | Permeability H-796 |
|---|---|---|---|---|
| Heat 8932 0.043% C, 0.094% Mn, 0.025% S, 2.90% Si, 0.040% Al, 0.0068% N | | | | |
| 1095° | 0.267 | 760° | 0.595 | 1905 |
| 1095° | 0.238 | 845° | 0.610 | 1875 |
| Heat 9906 0.043% C, 0.092% Mn, 0.027% S, 2.89% Si, 0.031% Al, 0.0073% N | | | | |
| 1115° | 0.284 | 982° | 0.665 | 1914 (average of 7 coils) |
| 1115° | 0.284 | 870° | 0.681 | 1904 (average of 4 coils) |

We claim:

1. In a process for producing oriented silicon steel having improved core loss and magnetic permeability in the rolling direction, comprising the steps of hot rolling a steel containing up to about 0.07% carbon, about 2.7% to about 3.3% silicon, about 0.05% to about 0.15% manganese, about 0.02% to about 0.035% sulfur and/or selenium, about 0.024% to about 0.040% total aluminum, about 0.0050% to about 0.0090% nitrogen, and balance essentially iron, subjecting the hot rolled steel to an initial anneal, cooling the steel, water quenching to a temperature below about 400° C. in less than about 200 seconds, cold rolling to final thickness, decarburizing the steel, applying an annealing separator, and subjecting the steel to a final anneal in a reducing atmosphere, the improvement which comprises varying the temperature of said initial anneal within the range of from about 1040° to less than about 1115° C. and the temperature at which said water quenching is started within the range of from about 700° to less than about 870° C. when the total aluminum and nitrogen contents are to the right of and below the straight lines defined by percent nitrogen=0.0090% and percent nitrogen=0.83×percent aluminum−0.022% in FIG. 2 herein, and varying the temperature of said initial anneal within the range of from greater than about 1115° to about 1175° C. and the temperature at which said water quenching is started within the range of greater than about 870° to about 1090° C. when the total aluminum and nitrogen contents are to the left of and above the straight lines defined by percent nitrogen=0.0060% and percent nitrogen=0.83×percent aluminum−0.0184% in FIG. 2 herein.

2. The improvement claimed in claim 1, wherein said hot rolled steel is water quenched after said initial anneal to a temperature below about 400° C. in from 10 to 50 seconds.

3. The improvement claimed in claim 1, wherein said initial anneal is a continuous anneal, with a soaking time ranging from about 30 seconds to about 3 minutes.

4. A process for producing oriented silicon steel having improved core loss and magnetic permeability, comprising the steps of hot rolling a steel containing up to 0.07% carbon, about 2.7% to about 3.3% silicon, about 0.05% to about 0.15% manganese, about 0.02% to about 0.035% sulfur and/or selenium, about 0.024% to about 0.040% total aluminum, about 0.0050% to about 0.0090% nitrogen, and balance essentially iron; subjecting the hot rolled steel to an initial anneal; cooling the steel; water quenching to a temperature below about 400° C. in less than about 200 seconds; the temperature of said initial anneal being varied within the range of from about 1040° to less than about 1115° C. and the temperature at which said water quenching is started being varied within the range of from about 700° to less than about 870° C. when the total aluminum and nitrogen contents are to the right of and below the straight lines defined by percent nitrogen=0.0090% and percent nitrogen=0.83×percent aluminum−0.022% in FIG. 2 herein, and the temperature of said initial anneal being varied within the range of from greater than about 1115° to about 1175° C. and the temperature at which said water quenching is started being varied within the range of from greater than about 870° to about 1090° C. when the total aluminum and nitrogen contents are to the left of and above the straight lines defined by percent nitrogen=0.0060% and percent nitrogen=0.83×percent aluminum−0.0184% in FIG. 2 herein; cold rolling to final thickness in at least one stage of cold reduction; decarburizing the steel; applying an annealing separator; and subjecting the steel to a final anneal in a reducing atmosphere at a temperature of at least about 1090° C.

* * * * *